US007532162B2

(12) United States Patent
Braam

(10) Patent No.: US 7,532,162 B2
(45) Date of Patent: May 12, 2009

(54) ANTENNA ARRANGEMENT FOR MOBILE COMMUNICATION TERMINALS

(75) Inventor: Reinhold Braam, Rhede (DE)

(73) Assignee: Palm, Inc., Sunnyvale, CA (US)

( * ) Notice: Subject to any disclaimer, the term of this patent is extended or adjusted under 35 U.S.C. 154(b) by 241 days.

(21) Appl. No.: 10/596,179

(22) PCT Filed: Nov. 22, 2004

(86) PCT No.: PCT/EP2004/013237

§ 371 (c)(1),
(2), (4) Date: Jun. 2, 2006

(87) PCT Pub. No.: WO2005/055367

PCT Pub. Date: Jun. 16, 2005

(65) Prior Publication Data

US 2007/0085740 A1 Apr. 19, 2007

(30) Foreign Application Priority Data

Dec. 3, 2003 (DE) ..... 103 56 511

(51) Int. Cl.
*H01Q 1/38* (2006.01)

(52) U.S. Cl. ..... 343/700 MS; 343/893

(58) Field of Classification Search ..... 343/853, 343/893, 700 MS
See application file for complete search history.

(56) References Cited

U.S. PATENT DOCUMENTS 6,501,427 B1 12/2002 Lilly et al.
2001/0054981 A1* 12/2001 Boyle ..... 343/702
2002/0149086 A1* 10/2002 Aoki ..... 257/528
2003/0052818 A1 3/2003 Subotic et al.
2005/0012675 A1* 1/2005 Sakiyama et al. ..... 343/824

FOREIGN PATENT DOCUMENTS

| | | |
|---|---|---|
| JP | 8265042 | 10/1996 |
| WO | WO0171849 | 9/2001 |
| WO | WO0180258 | 10/2001 |

OTHER PUBLICATIONS

IEEE Microwave and Wireless Components Letters, vol. 12, No. 12, Dec. 2002, Kang et al., "Feasibility Study on Beam Forming Technique With I-D Mechanical Beam Steering Antenna Using Niching Genetic Algorithm", pp. 494-496.

Gianvittorio et al., MEMS Enabled Reconfigurable Frequency Selective Surfaces; Design, Simulation, Fabrication and Measurement, pp. 404-407.

* cited by examiner

*Primary Examiner*—Trinh V Dinh
*Assistant Examiner*—Dieu Hien T Duong
(74) *Attorney, Agent, or Firm*—K & L Gates LLP

(57) ABSTRACT

The present disclosure relates to an antenna arrangement, comprising a regular array of electrically conducting antenna elements, arranged on a support, embodied and positioned to be displaced between a first position, in which an electrical contact to at least one adjacent antenna element is possible and a second position, with electrical isolation from the adjacent antenna element, a HF contact, for at least one of the antenna elements and a controller, for displacement of the antenna element between the first and second positions and for embodiment of a desired antenna structure.

9 Claims, 2 Drawing Sheets

ANTENNA ARRANGEMENT FOR MOBILE COMMUNICATION TERMINALS

This application is a 371 of PCT/EP04/13237 Nov. 22, 2004.

FIELD OF TECHNOLOGY

The present disclosure relates to an antenna arrangement for mobile communication terminals, in particular those which support a plurality of mobile radio communication standards.

BACKGROUND

Mobile communication terminals for supporting a plurality of mobile radio communication standards are being developed at the present time. For this purpose, it is necessary to provide an antenna arrangement which is able to operated in accordance with the stipulations of the individual mobile radio communication standards.

One possible approach in this regard is to provide a separate antenna for each of the mobile radio communication standards supported. In this case, it must be taken into account that currently conventional or future mobile radio standards differ, in principle, by virtue of the frequency range specifically reserved in each case. For a respective frequency range, that is to say for reception or transmission of electromagnetic signals within this frequency range, antennas are required which in a predominant number of cases have the length $\lambda/4$, where $\lambda$ is a wavelength within the frequency range.

In this context, the term "software defined radio" is of particular importance since this means mobile communication terminals which are intended to cover as many different mobile radio communication standards as possible and thus also receive different carrier frequencies. An antenna arrangement suitable for this may therefore either comprise a plurality of antennas or else a broadband antenna is used such that it can operate all the mobile radio standard frequency ranges supported. However, such a broadband antenna will have the disadvantage that it is not optimally adapted for a respective application in a specific frequency range of a mobile radio communication standard. This leads to losses for a received transmission power.

SUMMARY

Since an antenna arrangement comprising a plurality of antennas is very complex and a highly broadband antenna arrangement is of low adaptation quality, the present disclosure provides an antenna arrangement which can be adapted to a plurality of mobile radio standard frequency ranges.

An antenna arrangement under an exemplary embodiment includes a regular array of electrically conductive antenna elements arranged on a carrier, which antenna elements are formed and mounted in such a way that they can be moved between a first position, in which an electrical contact to at least one adjacent antenna element is made possible, and a second position, in which there is an electrical decoupling from the adjacent antenna element, an RF contact for at least one of the antenna elements, and a control device for moving the antenna elements between the first and the second position and for forming a desired antenna structure, proceeding from the at least one antenna element provided with the RF contact.

The provided array of antenna elements which can be changed over individually between a first position, which is an active position, and a second position, which is an inactive position, makes it possible, by connecting a desired number of antenna elements, to realize an antenna length suitable for a mobile radio standard frequency range currently being used. The control device used, which receives a request for realizing a specific antenna structure, brings about movement of a number of the antenna elements in such a way that the desired antenna structure is produced. For this purpose, the antenna elements selected for forming the antenna structure are moved into a respectively required position, namely the first position or the second position.

Transmission power received by an antenna structure depends on its position and orientation in the space. In this regard, the antenna arrangement affords the advantage that it can be altered or shifted in terms of its orientation in order to provide an optimization with regard to the received transmission power.

In this case, at least one of the antenna elements is formed with an RF contact for supplying electromagnetic signals to be transmitted or conducting away received electromagnetic signals. This antenna element serves as a starting point for an antenna structure that is to be established with the aid of further antenna elements. In order to be more flexible with regard to a realization of a desired antenna structure, it is possible to equip a plurality of the antenna elements or else all of the antenna elements with such an RF contact.

If a plurality of antenna elements are provided which are configured as a starting point for an antenna structure that is to be established with the aid of further antenna elements, the advantage afforded is that either in the sense of antenna "diversity" a gain is obtained with regard to a received transmission power or a parallel reception of different carrier frequencies assigned to different mobile radio standards is made possible.

The antenna elements are preferably formed as substantially rectangular laminae that can be rotated on pivots running parallel to one another. In this respect, the antenna elements lie on a pivot in a series one behind the other, in which case a distance in the axial direction between adjacent antenna elements should take account of the fact that a sufficient electromagnetic decoupling from one another can be obtained. In this embodiment, an antenna structure is defined by a plurality of antenna elements which are situated on different pivots.

It is advantageous if laminae adjacent to one another in a direction perpendicular to the pivots overlap in the first position and can be electrically conductively connected to one another in the overlap region. If, therefore, two antenna elements on mutually adjacent pivots are intended to be part of a desired antenna structure, both antenna elements are situated in the first position and are in electrically conductive contact with one another on account of the overlap region. Other embodiments are also conceivable which can be used to produce an electrically conductive contact between laminae of a common antenna structure.

In another embodiment, provision is made for permitting the laminae on mutually adjacent pivots to have an offset with respect to one another in the axial direction and a distance between the laminae that are adjacent on the pivots is less than an extent of the laminae in the axial direction, the offset being less than the extent of the laminae and greater than the distance.

These features ensure that a lamina on a specific pivot can be in electrically conductive contact simultaneously with two laminae on an adjacent pivot, so that arbitrary, for example also diagonally/obliquely extending antenna structures can be realized. This is advantageous insofar as it is possible firstly to attempt to realize a required antenna structure obliquely initially. If the required reception properties of this antenna structure are not satisfactory, further laminae adjoining the initial structure can be connected in along the pivots by said laminae being moved into the first position, in order thereby to improve the reception property.

The antenna elements are preferably arranged on a substrate, e.g. a semiconductor chip, as the carrier. The substrate functioning as the carrier preferably exhibits low losses. In this case, it is advantageous if each antenna element is arranged on an associated matrix element of a row/column matrix of the carrier and each antenna element is assigned a row address and a column address. In this way, with the aid of the row address and the column address, the control device can perform an individual driving of the antenna elements and move them from the first position into the second position, or vice versa.

A current position of an antenna element, namely either the first or the second position, can be stored in a respective memory element assigned to a matrix element of the row/column matrix of the semiconductor chip. This enables the control device to continuously draw conclusions about the currently realized antenna structure by reading from the memory elements.

In the exemplary embodiment of the invention where a carrier is integrated as a semiconductor chip, it is regarded as advantageous if also the control device for driving the antenna elements and also a circuit arrangement for RF signal processing are integrated on the semiconductor chip. In this case, the RF signal processing takes place in a customary manner with the aid of a suitable circuit arrangement which incoming signals supplied by the antenna elements are processed further.

Furthermore, it should be pointed out that all of the provided leads, connections and contacts which are used in the context of the antenna arrangement should be configured with low losses for the RF signals that are received or to be transmitted.

BRIEF DESCRIPTION OF THE DRAWINGS

The various objects, advantages and novel features of the present disclosure will be more readily apprehended from the following Detailed Description when read in conjunction with the enclosed drawings, in which.

DETAILED DESCRIPTION

Figure 1:
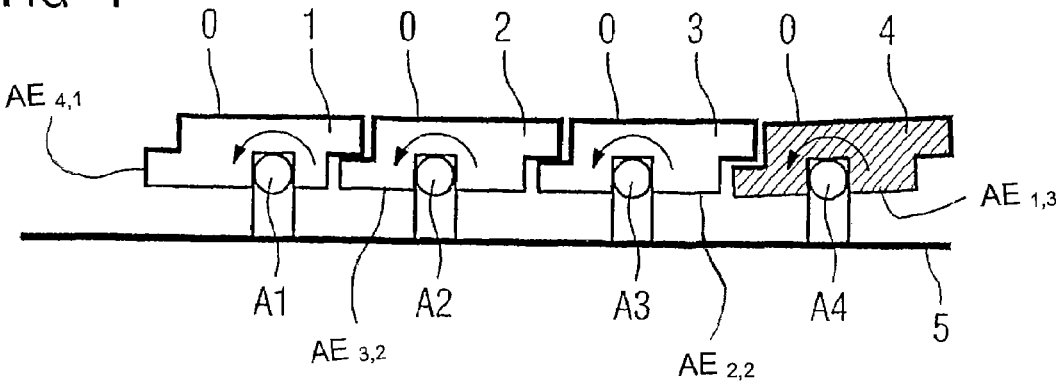
FIG. 1 illustrates a side view of an antenna arrangement for a mobile communication terminal.

As shown in FIG. 1, antenna elements $AE_{4,1}$, $AE_{3,2}$, $AE_{2,2}$, $AE_{1,3}$ (cf. FIG. 2) are preferably formed as metalized laminae, and lie on respectively associated pivots $A_1$, $A_2$, $A_3$, $A_4$ in the side view illustrated. The antenna elements $AE_{4,1}$, $AE_{3,2}$, $AE_{2,2}$, $AE_{1,3}$ are in each case mounted in rotatable fashion on the associated pivots $A_1$, $A_2$, $A_3$, $A_4$, so that they can be moved from a first, active position into a second, passive position. By way of example, in FIG. 1 the antenna elements $AE_{4,1}$, $AE_{3,2}$, $AE_{2,2}$ are situated in the first, active position (i.e., they are electrically conductively connected to oneanother), in order to form a desired antenna structure. By contrast, the antenna element $AE_{1,3}$ in FIG. 1 is tilted relative to the rest of the antenna elements $AE_{4,1}$, $AE_{3,2}$, $AE_{2,2}$ and, in particular, is decoupled from the adjacent antenna element $AE_{2,2}$ (hatched in FIG. 1).

In order to form the desired antenna structure, the antenna elements $AE_{4,1}$, $AE_{3,2}$, $AE_{2,2}$ —also the decoupled antenna element AE1,3 —are in each case provided with an electrically conductive surface O extending in such a way that when the first position is adopted, adjacent antenna elements such as the antenna elements $AE_{3,2}$ and $AE_{2,2}$ on adjacent pivots $A_2$, $A_3$ touch one another with their electrically conductive surfaces. A substrate for the antenna elements may be ceramic material that has been metalized with a metallic layer in order to form the electrically conductive surface O. In an alternative embodiment, the antenna elements may also be produced completely from metal.

Specifically, the metallic antenna elements $AE_{4,1}$, $AE_{3,2}$, $AE_{2,2}$, $AE_{1,3}$ are preferably formed in a substantially rectangular fashion but in each case have a step in the direction of adjacent antenna elements perpendicular to the pivots $A_1$, $A_2$, $A_3$, $A_4$, which step is provided with an associated section of the electrically conductive surface. The mutually opposite steps overlap one another and bear on one another if the antenna elements $AE_{3,2}$, $AE_{2,2}$ are in their first position and an electrical contact is produced between these antenna elements $AE_{3,2}$, $AE_{2,2}$. The antenna elements $AE_{4,1}$, $AE_{3,2}$, $AE_{2,2}$, $AE_{1,3}$, are arranged above a carrier 5, which is present in the form of a semiconductor chip, such that they can be rotated about their associated pivot $A_1$, $A_2$, $A_3$, $A_4$, and are supported mechanically on the semiconductor chip 5.

One possible realization of the rotatable mounting for the antenna elements $AE_{1,1}$, $AE_{1,2}$, $AE_{1,3}$, $AE_{1,4}$ is shown for example, in U.S. 2002/0109903 A1 which is incorporated by reference in its entirety herein. The document relates to a microelectromechanical system with optical applications. Based on this case, the antenna elements $AE_{1,1}$, $AE_{1,2}$, $AE_{1,3}$, $AE_{1,4}$ are formed as microelectromechanical elements whose position can be set with the aid of attractive or repulsive electrostatic forces.

A general structure of an array of antenna elements which also include the antenna elements $AE_{4,1}$, $AE_{3,2}$, $AE_{2,2}$, $AE_{1,3}$ explained with reference to FIG. 1 is revealed in FIG. 2. The illustration shows four rows of antenna elements $AE_{1,1}$, . . . ,$AE_{1,8}$,; $AE_{2,1}$, . . . , $AE_{2,8}$; $AE_{3,1}$, . . . , $AE_{3,8}$; $AE_{4,1}$, . . . , $AE_{4,8}$ arranged on respective pivots $A_1$, $A_2$, $A_3$, $A_4$. The indexing of the antenna elements follows the rule that the first index corresponds to the number of the associated pivot and the second index corresponds to the position of the antenna element from left to right in FIG. 2. Variations to the exemplary embodiment explained with reference to FIG. 2 are conceivable in which n pivots each having m antenna elements may be provided, where the number m of antenna elements need not necessarily be the same for all of the pivots.

Antenna elements arranged on adjacent pivots $A_1$, A2, $A_3$, $A_4$ have an offset parallel to the axes, which offset is dimensioned in such a way that—apart from the edge region—an axial position of an antenna element on one pivot corresponds approximately to the middle between two antenna elements on the other pivot. This enables the antenna element on one pivot to be simultaneously electrically conductively connected to two antenna elements on the other pivot. This has the advantage that reception properties of an antenna structure realized with the aid of the array of antenna elements can be optimized by connecting in further antenna elements, proceeding from an initial structure.

Figure 2:
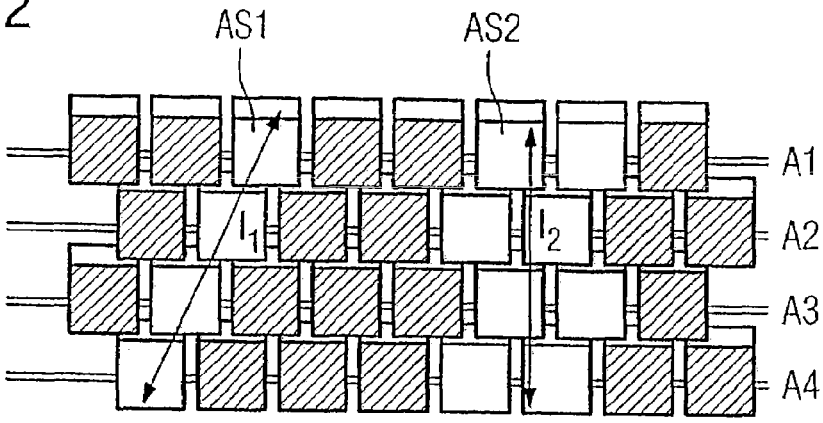
FIG. 2 illustrates a view from above of the antenna structure from FIG. 1.

The array of antenna elements illustrated in FIG. 2 has a general matrix structure, each antenna element being assigned a unique row position n and a unique column position m. An antenna element can be identified by means of these position specifications.

FIG. 2 illustrates by way of example two different antenna structures which can be realized with the array of antenna elements. A first antenna structure AS1 having a length $1_1$ is preferably formed by four antenna elements each lying in the first, active position. The four antenna elements extend obliquely with respect to the pivots on which the array of antenna elements is arranged. An outer antenna element of the antenna structure AS1 is provided with an RF contact and serves for coupling in received signals and/or coupling out signals to be transmitted into/out of the semiconductor chip 5. A received signal can thus be fed to an RF processing device.

For a maximum variability of the array of antenna elements, each individual antenna element may be equipped with such an RF contact.

A second antenna structure AS2 having a length $1_2$ in FIG. 2 is preferably formed by a total of eight antenna elements which are electrically conductively connected to one another. In each case two antenna elements of a pivot contribute to the antenna structure.

A comparison of the antenna structure AS1 with the antenna structure AS2 makes it clear that, by connecting in further antenna elements, the antenna structure AS1, which is contained by the positioning of the antenna elements involved in the antenna structure AS2, can be modified in order to improve reception properties. FIG. 2 additionally illustrates that antenna structures can be constructed not only in the horizontal or vertical direction, rather it also becomes possible to form arbitrary antenna structure areas in the predetermined grid of the antenna elements.

Since the two examples for antenna structures have a different antenna length, it can additionally be established that the array of antenna elements can realize two antenna structures which support different mobile radio standards. In this respect, the requirements made of an antenna arrangement for "software defined radio" devices are taken into account.

Figure 3:
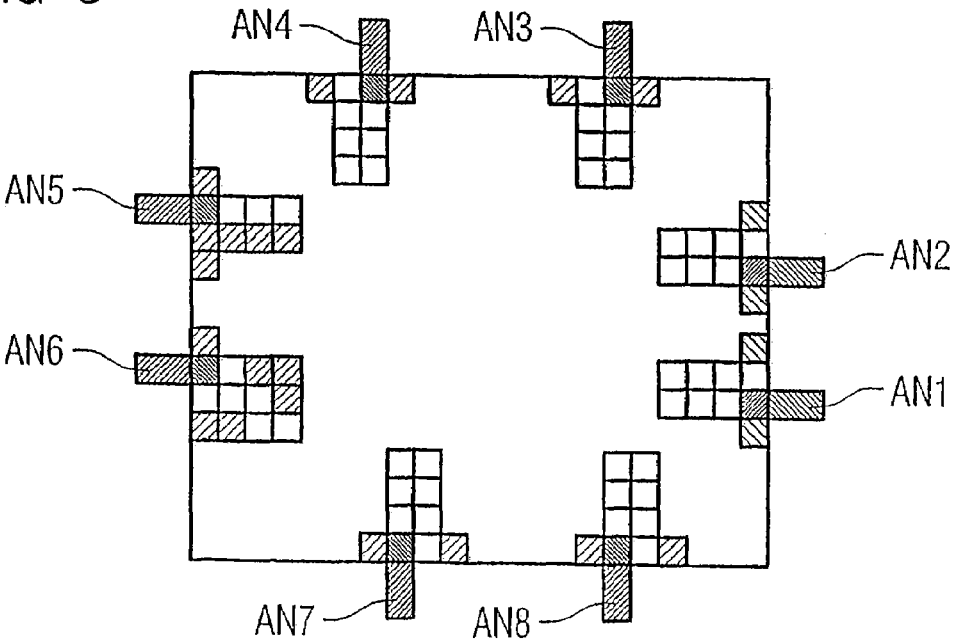
FIG. 3 illustrates a view from above of a substrate as a carrier for a plurality of antenna structures.

FIG. 3 reveals an exemplary embodiment of a substrate serving as a carrier in the form of a semiconductor chip 5. The semiconductor chip 5 is preferably formed in rectangular fashion and has in each case two connections $AN_1, AN_2, \ldots AN_8$ at each of its side edges. Each of the connections $AN_1, \ldots AN_8$, acting as RF contacts, is fixedly electrically connected to a particular antenna element serving as an initial element for forming an antenna structure. FIG. 3 shows a total of eight antenna structures which are based on the respective connections $AN_1, \ldots, AN_8$ and partly deviate from one another in terms of their form. It should be emphasized that the semiconductor chip 5 can be equipped with antenna elements over its entire surface, FIG. 3 primarily illustrating active antenna elements and, if appropriate, adjacent inactive antenna elements.

Figure 4:
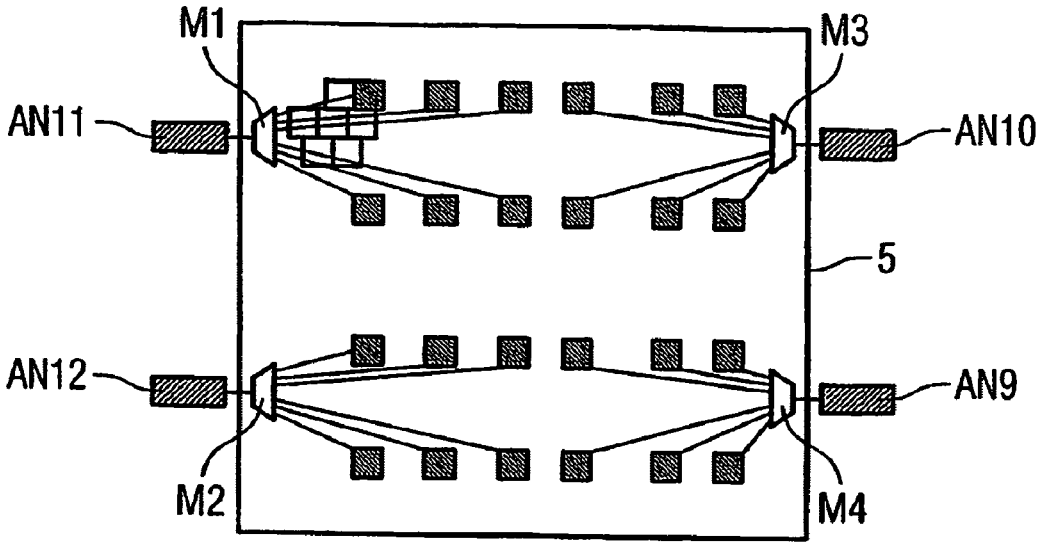
FIG. 4 illustrates a view from above of a substrate with a plurality of common RF connections for antenna structures.

FIG. 4 illustrates a further exemplary embodiment of an antenna arrangement on the semiconductor chip 5. In contrast to the exemplary embodiment according to FIG. 3 , particular antenna elements embodied as coupling-in/out elements in the exemplary embodiment according to FIG. 4 are not arranged at the edge of the semiconductor chip 5, but rather in the inner region thereof. At its edge, the semiconductor chip 5 has a total of four RF connections $AN_9, \ldots, AN_{12}$, which are provided as RF contacts and are in each case assigned a low-loss multiplexer $M_1$, $M_2$, $M_3$, $M_4$, which is likewise realized on the semiconductor chip 5. In the exemplary embodiment illustrated, each of the multiplexers $M_1, \ldots, M_4$ is connected to six antenna elements $AE_{n,m}$ which may by themselves alone serve as coupling-in/coupling-out elements for RF signals. For reasons of clarity, FIG. 4 illustrates only one antenna structure at the antenna element arranged top left in FIG. 4. The semiconductor chip 5 of FIG. 4 can also be provided with antenna elements completely over its surface.

Likewise for reasons of clarity, pivots serving for the mounting of the antenna elements are not depicted in FIGS. 3 and 4.

Figure 5:
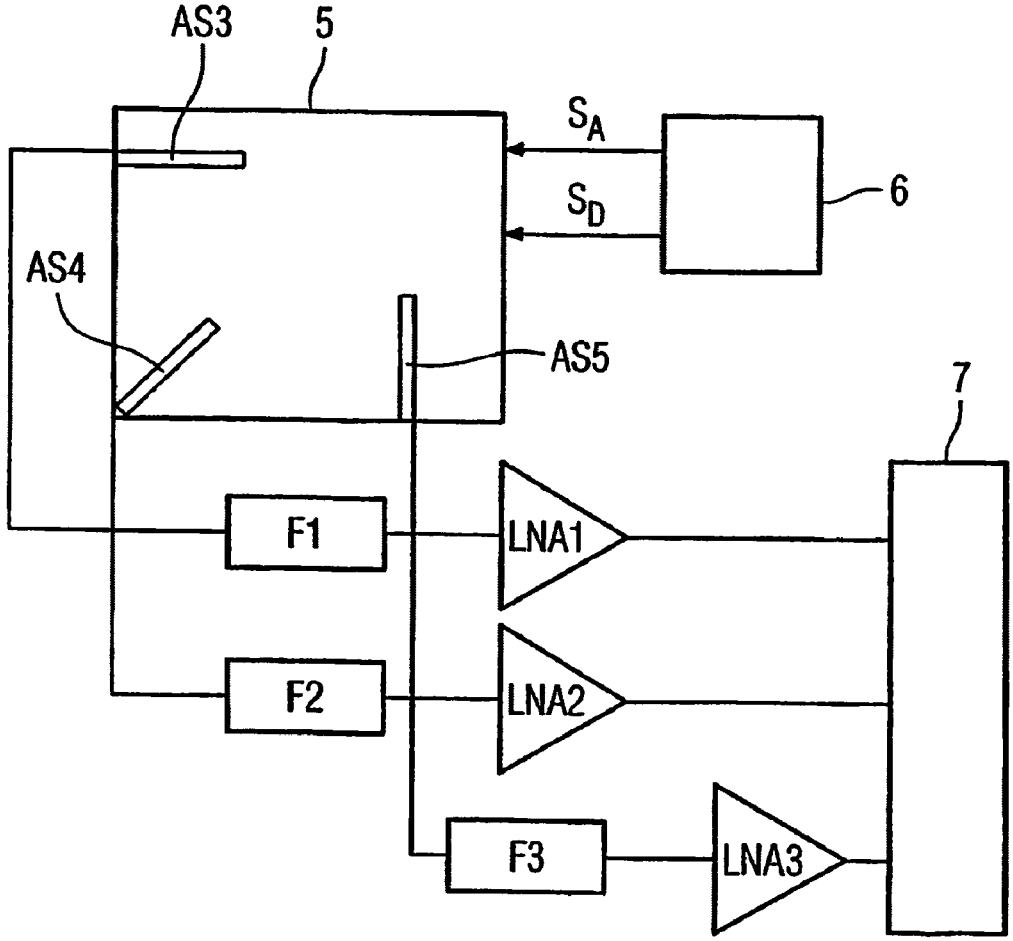
FIG. 5 illustrates a schematic overview illustration of an antenna chip with external control.

FIG. 5 reveals a circuit structure which comprises the semiconductor chip 5 and serves for addressing and controlling the individual antenna elements of the array. A control device 6 in the form of a microprocessor acquires input values that represent which antenna structures are required for currently supported mobile radio standards. The control device 6 drives a number of the antenna elements of the array in such a way that they are in the first, active position, while adjacent antenna elements are brought to the second, inactive position if they were previously situated in the active, first position. For this purpose, the control device 6 sends suitable control signals to the affected antenna elements $AE_{n,m}$. In this case, for each antenna element, there is storage locally on the semiconductor chip 5 at the associated matrix position n, m whether said element is in the first position or in the second position.

In the exemplary embodiment illustrated, address signals SA and data signals $S_D$ proceed from the control device 6, the address signals $S_A$ designating respective antenna elements, while the data signals $S_D$ comprise the information as to whether a currently addressed antenna element is intended to assume the active or the passive position.

In the illustration according to FIG. 5, three exemplary antenna structures AS3, AS4, AS5 are realized on the semiconductor chip 5. The associated coupling antenna elements of said antenna structures not illustrated for reasons of clarity.

RF signals received by the three antenna structures AS3, AS4, AS5 pass for further processing to an RF chip 7, and also passing through respective reception filters F1, F2, F3 and also associated low-noise RF amplifiers (LNA=low-noise amplifier) LNA1, LNAA2, LNAA3.

Although FIG. 5 illustrates the semiconductor chip 5 in such a way that it exclusively carries antenna elements and associated connections, the control device 6 and also the reception filters F1, F2, F3 and their associated RF amplifiers LNA1, LNA2, LNA3 may be concomitantly implemented on the semiconductor chip 5.

While the invention has been described with reference to one or more exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

The invention claimed is:

1. An antenna arrangement, comprising:

an array of electrically conductive antenna elements arranged on a carrier, wherein antenna elements are formed and mounted in such a way that said antenna elements are movable between a first position, in which an electrical contact to at least one adjacent antenna element is made, and a second position, in which there is an electrical decoupling from the adjacent antenna element, wherein the antenna elements are formed as rectangular laminae, and the antenna element are rotatable on the pivots which are parallel to each other;

at least one RLF contact provided for at least one of the antenna elements; and a control device for moving the antenna elements between the first and the second position and for forming a variable antenna structure, proceeding from the at least one antenna element provide with the at least one RF contact.

2. The antenna arrangement as claimed in claim 1, wherein the antenna elements for coupling in or coupling out an antenna signal are provide with the at least one RF contact.

3. The antenna arrangement as claimed in claim 2, wherein the antenna elements provided with the at least one RF contact are arranged at an edge of the carrier.

4. The antenna arrangement as claimed in claim 2, wherein the antenna elements provided with the at least one RF contact are arranged in an inner region of the carrier, and wherein a respective portion of the antenna elements is connected via leads to a multiplexer connected to a another of the at least one RF contact.

5. The antenna arrangement as claimed in claim 1, wherein laminae associated with the array of electrically conductive antenna elements are adjacent to one another in a direction perpendicular to the pivots overlap in the first position and are optionally electrically conductively connected to one another in the overlap region.

6. The antenna arrangement as claimed in claim 1, wherein the antenna elements are arranged on a semiconductor chip as the carrier.

7. The antenna arrangement as claimed in claim 6, wherein each antenna element is arranged on an associated matrix element of a row/column matrix of the semiconductor chip and each antenna element is assigned a row address and a column address.

8. The antenna arrangement as claimed in claim 6, wherein the control device is integrated on the semiconductor chip.

9. The antenna arrangement as claimed in claim 6, wherein a circuit arrangement for RF signal processing is integrated on the semiconductor chip.

* * * * *